United States Patent [19]

Cabrera et al.

[11] 4,136,970

[45] Jan. 30, 1979

[54] METHOD AND APPARATUS FOR REGULATING THE SIZE AND FREQUENCY OF BUBBLES EMPLOYED FOR MIXING LIQUIDS

[75] Inventors: Pedro P. Cabrera; Robert T. Duncan, both of Miami, Fla.

[73] Assignee: Coulter Electronics, Inc., Hialeah, Fla.

[21] Appl. No.: 860,674

[22] Filed: Dec. 15, 1977

[51] Int. Cl.[2] ..... B01F 13/02

[52] U.S. Cl. ..... 366/101; 366/107

[58] Field of Search ..... 366/101, 102, 106, 107, 366/290

[56] References Cited

U.S. PATENT DOCUMENTS

| | | | |
|---|---|---|---|
| 3,159,383 | 12/1964 | Munster | 366/107 |
| 3,588,053 | 6/1971 | Rothermel | 366/101 |
| 3,671,018 | 6/1972 | McKibben | 366/107 |

*Primary Examiner*—Edward J. McCarthy

*Attorney, Agent, or Firm*—Coulter Electronics, Inc.

[57] ABSTRACT

A few large, fast rising gas bubbles are generated near the bottom of a sample container and the upward movement of the bubbles causes a mixing action of the sample. The bubbles result from the periodic injection of discrete quantums of gas into the bottom of the container. The volume of a discrete gas quantum determines the size of a resulting bubble. Both the volume and frequency of generation of the quantums of gas are controlled by a timing circuit which operates a solenoid valve that permits each discrete quantum of gas to pass into the sample container.

23 Claims, 2 Drawing Figures

SAMPLE CONTAINER
GAS SOURCE
REGULATOR
FREQUENCY
SIZE

GAS SOURCE

+5 V.
+24 V.
42
44

METHOD AND APPARATUS FOR REGULATING THE SIZE AND FREQUENCY OF BUBBLES EMPLOYED FOR MIXING LIQUIDS

BACKGROUND OF THE INVENTION

The use of gas bubbles for mixing the contents of a sample container is well known. U.S. Pat. Nos. 3,549,994 and 3,588,053 both teach such use of bubbles for the mixing of biological samples. The sample contains microscopic particles that are to be analyzed by passing the mixed sample through a microscopic path defined by an aperture in the wall of an analyzing vessel. U.S. Pat. Nos. 3,567,321 and 4,014,611 disclose forms of such analyzing vessel. Method and apparatus for accomplishing such analysis are taught in U.S. Pat. Nos. 2,656,508 and 3,259,842. All the above patents are directed to methods and apparatuses intended for use in a Coulter particle analyzing device. The mark "Coulter" is the Registered trademark, registration No. 995,825 of Coulter Electronics, Inc. of Hialeah, Florida. To the extent that a better understanding of the present invention may require, these six patents are incorporated herein as a part hereof by specific reference.

U.S. Pat. Nos. 3,549,994 and 3,588,053, especially the latter, teach that the mixing bubbles should be large and not break apart to form microscopic bubbles which might appear to the analyzing elements as being the microscopic particles which are to be analyzed. Also, the bubble induced mixing action should not be turbulent, which also would generate microscopic bubbles. According to the teachings of these two patents and commercial structures sold for many years, a continuous stream of gas is fed for the duration of the mixing by valves and control elements, including a needle valve, into the sample container. The continuous gas stream, when it enters the bottom of the container having therein liquid sample, breaks up into parts that then form relatively large bubbles. U.S. Pat. No. 3,588,053 states that the bubbles are on the order of 1,000 to 3,000 microns in diameter. The needle valve regulates the amount of entering gas and thus can control the amount of mixing action — more gas resulting in more bubbles per unit time, within certain limits. Such bubble formation control has been satisfactory, but has required adjustment by the instrument operator to maintain sufficient but not turbulent mixing action. Heretofore, mixing by bubbles in a particle analyzer of the Coulter type was directed to blood particles, the smallest of which was the red blood cell having a typical volume of ninety cubic microns, which has an equivalent diameter of five and one-half microns. Hence, if the mixing bubbles and mixing action resulted in the generation of very small bubbles, smaller than sixty-five cubic microns, which has an equivalent diameter of five microns, those bubbles would not be mistaken for a red blood cell and in fact could be excluded by electronic threshold circuits.

However, the need to analyze small particles, such as blood platelets, which are much smaller than red blood cells, has brought with it the advent of more sophisticated particle analyzing equipment, having the capability of analyzing smaller particles than before, but also increased sensitivity to the generation of undesirable very small bubbles by the mixing arrangement above described. Although the quantity of these very small bubbles could be reduced by closing down the needle valve to produce fewer of the large mixing bubbles, there resulted insufficient mixing action. Attempts to reduce the number of mixing bubbles and to increase their size to obtain adequate mixing action by needle valving proved unsuccessful.

SUMMARY OF THE INVENTION

The present invention seeks to reduce the problems of the prior art bubble mixing arrangement by providing method and apparatus by which the generation of the mixing bubbles is better regulated and need not be adjusted frequently by the operator of the analyzer. When adjustment may be needed, such adjustment can be accomplished better and faster than with the needle valve of the prior art. The size and the frequency of the bubbles are adjustable separately and the bubbles can be made quite large, as compared with those of the prior art. This in turn allows for fewer bubbles to achieve the desired nonturbulent mixing. The fewer and significantly larger bubbles according to the present invention cause the formation of only relatively few of the microscopic bubbles in the platelet particle size range.

According to the teachings of the present invention, discrete quantums of gas separately are injected into the bottom of the sample container, in contrast to the continuous stream of gas injected according to the prior art. Each quantum has its volume determined by a timing circuit that operates a solenoid valve coupled to the gas line. In this manner, each gas quantum defines a single very large bubble that forms in the sample container. Bubbles of at least one-half cubic centimeter are formed; i.e., having an equivalent diameter of at least one centimeter. This is one thousand times larger than those produced by the 1,000 micron diameter bubbles of the prior art and at least three hundred and seventy times larger in volume than the 3,000 micron diameter bubbles mentioned in U.S. Pat. No. 3,588,053. The spacings between the gas quantums also are determined by the timing circuit and the solenoid valve.

As employed herein, the term "gas" refers to a preferred substance for the mixing bubbles. Other substances lying within the generic terms of "fluids" and "liquids" also could be employed if such substances were less dense than the sample container content, which typically is a saline solution in which the blood cell sample is to be suspended. The difference in density enables the bubbles to rise and provides the mixing action. Yet also, the bubble substance should not contaminate the sample material.

DESCRIPTION OF THE PREFERRED EMBODIMENT

Figures 1, 2:
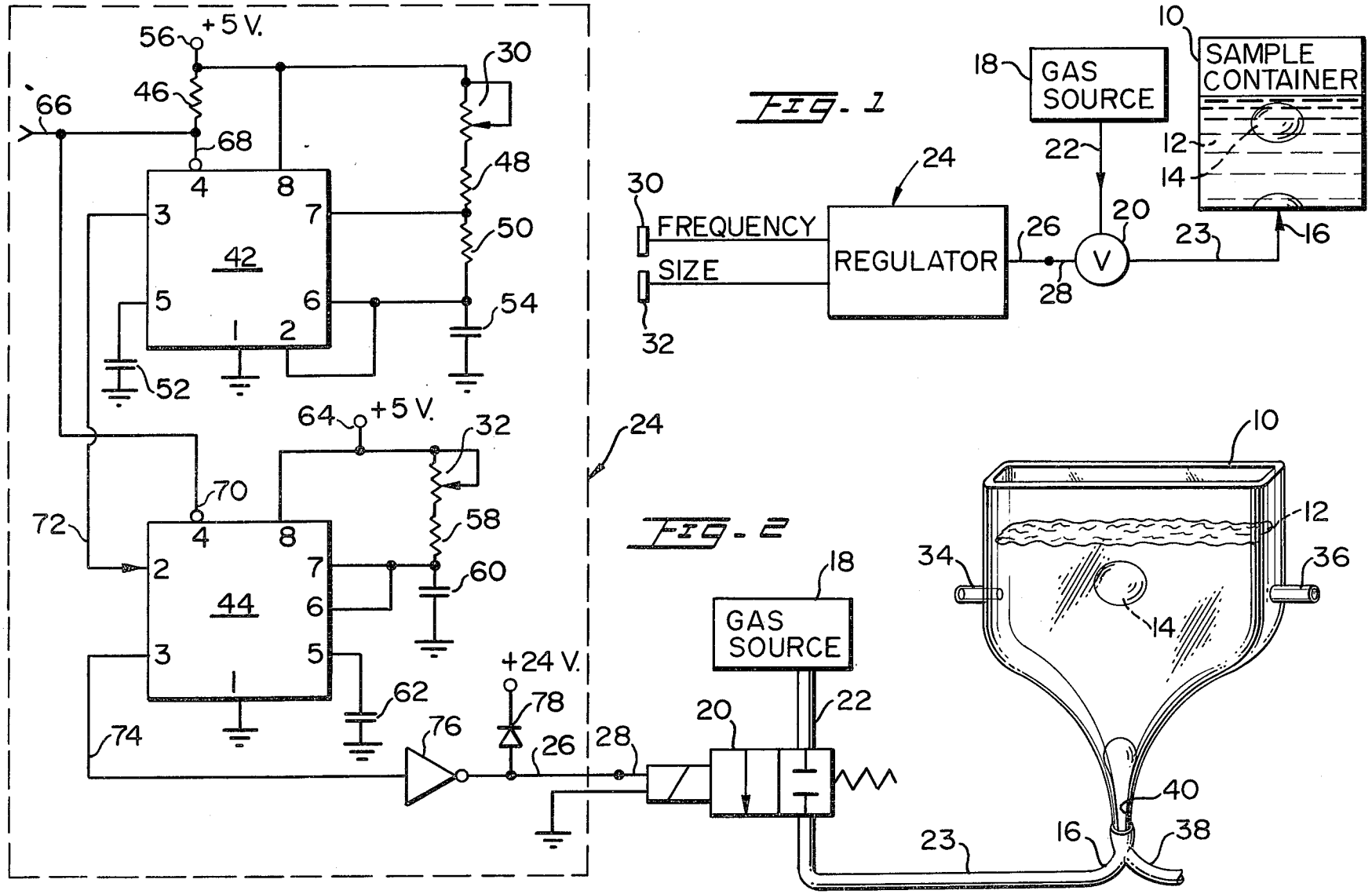
FIG. 1 is a simplified block diagram for explaining the operation and use of the invention.
FIG. 2 is a schematic diagram of a preferred embodiment of the invention feeding bubbles into an analyzing vessel.

In FIG. 1 is shown a sample container 10 having sample liquid 12 which is to be mixed by bubbles, such as the large bubble 14, which rise relatively fast from an entry port 16 at the bottom of the container. A source of gas 18 under pressure feeds the gas through a valve 20 along conduits 22 and 23 to the entry port 16. The conduits 22 and 23 normally are filled with the gas, but the valve 20 normally is shut so that gas from the source 18 does not move through the conduit 23 and the entry port 16 into the sample container 10. A regulator 24 has its output coupled by a control line 26 to the control input 28 of the valve 20. The regulator has separate adjustment means, such as fine tuning knobs 30 and 32. The adjustment means 30 will control the frequency of the injection of the discrete quantums of gas into the sample container from which the bubbles are formed; and the adjustment means 32 will control the size of the bubbles in the manner next to be described.

The regulator 24 has the function of regulating the opening and closing of the valve 20. When the valve is open, the gas from the source 18 flows through the conduits 22 and 23 and into the container 10 via its port 16. The valve will be held open for a very short time, just long enough for a sufficient quantum of gas to pass through conduit 23 to form a discrete large bubble 14 in the container. The valve quickly is closed by the regulator and held closed until the frequency control portion of the regulator next signals the opening of the valve. Each short duration that the valve is open determines each discrete quantum of gas that is injected into the container 10. The longer that the valve is open, the larger the discrete gas quantum will be and, within certain limits, the larger the bubble will be. However, if the valve is held open too long, the quantum of gas will be so large that as it is injected into the sample container, the forces that normally cause the formation of only one bubble will act to rupture the one quantum of gas to form more than one bubble. Such rupturing action is undesirable, since it causes the formation of the very small blood cell particle sized bubbles. Yet also, if the bubble is too large, when it ascends to the top of the sample liquid 12 and breaks up, the force of such breaking up will be too great and cause the formation of the undesirable, very small bubbles.

Thus, it will be appreciated that the goal is not to maximize the size of the mixing bubbles, but to optimize their size so that each will be large for mixing purposes, but at the same time not so large as to result in the formation of many of the undesirable very small bubbles. Since the formation of each bubble 14 will, even when optimized, be accompanied by the formation of some of the undesirable small bubbles, it becomes necessary to regulate the number of the large bubbles 14 to be as few as possible to accomplish the desired amount of mixing action in the container 10. By use of the independent size and frequency control means 30 and 32 there can result the desired mixing action with a minimum of the very small bubbles. Such adjustment can be accomplished at the factory and no longer would need to be adjusted by the operator of the particle analyzer, as was the prior art circumstance.

Looking now at the schematic diagram of FIG. 2, in which the common elements from FIG. 1 carry the same reference numbers, the sample container 10 is shown to be a particle analyzing vessel or "bath" generally similar to that described in U.S. Pat. Nos. 3,567,321 and 4,014,611. Because of the quality of mixing achieved by the present invention, the bubble generation can be accomplished in the analyzing vessel, rather than in a separate mixing vessel, as taught in U.S. Pat. Nos. 3,549,994 and 3,588,053. Of course, the invention is not limited to use with a particle analyzing vessel or even particle analysis. In addition to the gas entry port 16, the container 10 is provided with ports 34, 36 and 38 for receiving sample and diluent liquids and draining the container. The lower portion of the container has its interior in the form of an elongate bore 40 with an outwardly curving profile moving upward from the gas entry port 16. The bore is shaped similar to that shown in U.S. Pat. No. 3,567,321, but serves a somewhat different purpose. According to U.S. Pat. No. 3,567,321 the sample was introduced into the bottom of the container and the curved profile of the bore enhanced the smooth upward flow of sample liquid into the container so that there was not generated turbulence, bubbles, nor any mixing action. In the operation of the present invention, the curved profile has a total included angle of approximately 14° and permits the injected, discrete quantum of gas to move smoothly upward and retain its unitary existence as it is forming into a bubble, rather than breaking apart into more than one bubble, as would be the situation if the included angle was significantly greater, for example the shape of the analyzing vessels in U.S. Pat. No. 3,549,994. Likewise, if the bore 40 was of substantially uniform cross section, as shown in U.S. Pat. No. 3,588,053, the entry of the quantum of gas out from the top of the bore into the wide mouth near the bottom of the container would be so abrupt that each quantum of gas would burst apart into several small mixing bubbles and numerous of the very small undesirable bubbles.

A preferred form of the controlled valve 20 is a solenoid valve, as illustrated in FIG. 2. A commercially available valve of this type which has been found to operate well as part of the invention is the Electronic Valve EV-2-24 manufacturered by Clippard Instrument Laboratory, Inc., Cincinnati, Ohio.

The gas source 18 can be any of many convenient supplies of low pressure air, or the like. A 5 psi source is adequate for purposes of the invention. Again it is to be noted that the herein use of "air" and "gas" is not limiting and that various other forms of fluid, including liquid could be employed as the substance being injected in discrete quantums into the container for formation of the mixing bubbles. As long as the injected quantums of substance will form fast rising bubbles of the desired size and will not diffuse or otherwise admix with the sample material which is being analyzed as a contaminant to the sample material, the choice of bubble forming substance is not critical.

The regulator 24 can be designed in many ways. In fact, the regulator 24 and controlled valve 20 need not be separate devices, nor even primarily electrical, as in the following described preferred embodiment. An assemblage that performs the functions of the valve 20 and regulator 24 is encompassed within the scope of the invention. For example, a peristaltic pump or other forms of metering devices could be employed alone or with other well known devices for injecting predetermined, discrete quantums of a substance at a regulated rate for forming mixing bubbles in a container.

The illustrated form of regulator 24 in FIG. 2 primarily comprises two timing elements 42 and 44. The element 42 is designed and coupled with adjacent components 30, 46–54, leads and voltage supply 56 to define an astable multivibrator. The timing element 44 is designed and coupled with adjacent components 32, 58–62, leads and voltage supply 64 to define a one-shot circuit. Both of these timing elements can be obtained from two of the same integrated circuits, a NE555T timer manufactured by Signetics Corporation, Sunnyvale, California. Of course other forms of astable multivibrators and one-shot circuits could be employed. The pin numbers 1 through 8 illustrated are those designated by the manufacturer.

An enable input 66 is coupled to the so-called reset input pins 4 of both timers. The trigger input signal on the enable input 66 will be a low or ground signal level; hence, the lead lines 68 and 70 into the respective 4 pins are inverted as illustrated. The output from the multivibrator 42 is on pin 3 and is applied by a line 72 to pin 2, the trigger input of the one-shot 44. Resistor 50 in cooperation with capacitor 54 determine a defined trigger duration to device 44. The resistors 30,48 and 50 of the multivibrator cooperate with the capacitor 54 to form an RC timing circuit and, since the resistor 30 is variable, there is provided the adjustability of the frequency of the pulses from the multivibrator. Similarly, the variable resistor 32, the resistor 58, and the capacitor 60 form an adjustable RC timing circuit for regulating the duration of the one-shot pulses, which are the output signals from pin 3 of the one-shot circuit onto a line 74. Since there is the common enable input on pins 4, and the frequency variable output from the multivibrator triggers the input of the duration variable one-shot, the output pulses on the line 74 are independently regulatable as to duration and frequency. The output pulses on the line 74 are applied to an inverter driver 76, the output from which is the control line 26 that is connected to the control input 28 of the solenoid valve 20. A circuit protective diode 78 also is connected to the line 26. Each pulse on the timer output line 74 opens the normally closed solenoid valve for the duration of the pulse and thereby couples the gas source 18 to the input port 16 for that duration so that one discrete quantum of gas is injected into the container 10, for forming one mixing bubble 14. Pulse durations of twenty milliseconds and a pulse frequency of two per second for seven seconds have provided especially desirable mixing bubbles having sufficient mixing action without turbulence and with few resulting undesirable microscopic bubbles. Thus the goals of the invention have been achieved.

Component specification and values for the elements in the regulator can be as follows:

resistor 30 . . . 100K ohms
resistor 32 . . . 50K ohms
resistor 46 . . . 4.7K ohms
resistor 48 . . . 47K ohms
resistor 50 . . . 1K ohms
resistor 58 . . . 22K ohms
The resistors can be ¼ watt, ±10%.
capacitor 52 . . . 0.01; microfarads, 100 volts, ceramic
capacitor 54 . . . 10; microfarads, 10 volts, electrolytic
capacitor 60 . . . 0.39; microfarads, 200 volts, plastic film
capacitor 62 . . . 0.01; microfarads, 100 volts, ceramic
driver 76 . . . 7406
diode 78 . . . IN4003

It is believed that those skilled in the art will, from the hereinabove specification, Figures, and following claims be able to understand and practice the invention and appreciate its intended scope.

What is sought to be protected by United States Letters Patent is:

1. Method for generating bubbles for use in mixing sample material in a container, said method comprising the steps of: defining discrete quantums of a substance having a density less than the density of the sample material, and injecting said quantums separately in time spaced sequence into the container near its bottom, said defining and injecting being coactive such that each separate quantum forms a bubble of the substance that will rise through sample material in the container and in so rising will mix the sample with a minimum of turbulence.

2. Method according to claim 1 in which said step of defining includes regulating the volume of each quantum of substance.

3. Method according to claim 2 in which said regulating causes each quantum of substance to be substantially equal in volume.

4. Method according to claim 3 in which the volume of each quantum results in the generation of a bubble in the order of one-half cubic centimeter.

5. Method according to claim 1 in which said defining is accomplished by regulating the opening and closing of a valve through which will pass the quantum of substance when the valve is open.

6. Method according to claim 5 in which said regulating is accomplished by generating timing pulses and applying the timing pulses to the valve, each applied timing pulse defining the duration that the valve is open and thereby defining the volume of the quantum of the substance.

7. Method according to claim 6 in which the duration of each timing pulse approximates twenty milliseconds.

8. Method according to claim 1 in which the substance is a fluid.

9. Method according to claim 8 in which the fluid is air under pressure.

10. Method according to claim 1 in which said injecting is accomplished by establishing a pressure differential between the sample material in the container and the discrete quantums of substance, the magnitude of such pressure differential being small enough so that each quantum of substance enters the container and forms one relatively large bubble, rather than more than one bubble.

11. Method according to claim 1 in which said time spaced injecting is accomplished by periodically triggering the opening of valve control means for permitting the substance to be injected into the container.

12. Method according to claim 1 in which said triggering approximates a frequency of two per second.

13. Method for generating bubbles for use in mixing sample material in a container, said method comprising the steps of: establishing a pressure differential between the sample material and a substance from which the bubbles will be formed, such that the substance can be injected into the container significantly below the surface of the sample material, providing a flow path for the injection of the substance into the container, and interrupting the flow in the path in a regulated manner such that discrete quantums of the substance are defined prior to injection into the container.

14. Apparatus for generating bubbles for use in mixing sample material in a container, said apparatus comprising: means for defining discrete quantums of a substance having a density less than the density of the sample material, and means for injecting said quantums separately in time spaced sequence into the container near its bottom, said defining and injecting means being coactive such that each separate quantum forms a bubble of the substance that will rise through sample material in the container and in so rising will mix the sample with a minimum of turbulence.

15. Apparatus according to claim 14 in which said defining means includes means for regulating the volume of each quantum of substance to be substantially equal in volume.

16. Apparatus according to claim 14 in which said defining means includes means for regulating the opening and closing of a valve through which the substance will pass on its way to the container, the volume of substance passing through the valve when opened being said quantum of substance.

17. Apparatus according to claim 16 in which said valve regulating means includes means for generating timing pulses to the valve for initiating the opening of the valve.

18. Apparatus according to claim 17 in which the valve is a solenoid valve and the duration of a timing pulse is the duration that the valve is open.

19. Apparatus according to claim 17 in which said means for generating timing pulses includes means for establishing at least one and preferably both the duration of each timing pulse and the frequency of a series of the timing pulses.

20. Apparatus according to claim 19 in which the timing pulse generating means comprises an astable multivibrator having its output coupled to the trigger input of a one-shot circuit, the outputs from which are the timing pulses.

21. Apparatus according to claim 20 in which the astable multivibrator includes means for adjusting the frequence of the timing pulses and the one-shot circuit includes means for adjusting the duration of the timing pulses, both said adjusting means being independently operable.

22. Apparatus according to claim 14 in which said container is the analysis vessel of an analyzer of microscopic particles, the vessel has a lower portion which includes an elongate bore into which the discrete quantums of substance are to be injected, and said bore has a curved profile which causes the cross section of said bore to increase gradually in the upward direction.

23. Apparatus for generating bubbles for use in mixing sample material in a container, said apparatus comprising: means for establishing a pressure differential between the sample material and a substance from which the bubbles will be formed, such that the substance can be injected into the container significantly below the surface of the sample material, means for providing a flow path for the injection of the substance into the container, and means for interrupting the flow in the path in a regulated manner such that discrete quantums of the substance are defined prior to injection into the container.

* * * * *